US008003591B2

(12) United States Patent
Motson et al.

(10) Patent No.: US 8,003,591 B2
(45) Date of Patent: Aug. 23, 2011

(54) METHOD FOR CONDITIONING TEXTILES

(75) Inventors: Harold Russell Motson, Cleveland (GB); Derek John Irvine, Cleveland (GB); Steven Huntley, Cleveland (GB)

(73) Assignee: Croda International PLC, Goole, East Yorkshire (GB)

( * ) Notice: Subject to any disclaimer, the term of this patent is extended or adjusted under 35 U.S.C. 154(b) by 540 days.

(21) Appl. No.: 10/525,042

(22) PCT Filed: Aug. 20, 2002

(86) PCT No.: PCT/GB02/03828

§ 371 (c)(1), (2), (4) Date: Aug. 29, 2005

(87) PCT Pub. No.: WO2004/018764

PCT Pub. Date: Mar. 4, 2004

(65) Prior Publication Data

US 2006/0107467 A1 May 25, 2006

(51) Int. Cl.
*D06L 1/00* (2006.01)

(52) U.S. Cl. ..... 510/285; 510/290; 510/289; 510/407; 510/291; 8/142; 8/137; 8/111; 134/26; 134/42; 134/10

(58) Field of Classification Search ..... 510/285, 510/290, 289, 407, 291; 8/142, 137, 111; 134/26, 42, 10

See application file for complete search history.

(56) References Cited

U.S. PATENT DOCUMENTS

| | | | | |
|---|---|---|---|---|
| 5,676,705 | A * | 10/1997 | Jureller et al. | 8/142 |
| 5,858,022 | A * | 1/1999 | Romack et al. | 8/142 |
| 6,148,645 | A | 11/2000 | DeYoung et al. | |
| 6,189,346 | B1 * | 2/2001 | Chen et al. | 68/5 R |
| 6,200,352 | B1 | 3/2001 | Romack et al. | |
| 6,258,766 | B1 * | 7/2001 | Romack et al. | 510/291 |
| 6,369,014 | B1 | 4/2002 | Murphy et al. | |
| 6,558,432 | B2 * | 5/2003 | Schulte et al. | 8/142 |
| 7,097,667 | B2 * | 8/2006 | Reinhoudt et al. | 8/142 |
| 2002/0010965 | A1 | 1/2002 | Schulte et al. | |
| 2004/0031107 | A1 | 2/2004 | Pegelow et al. | |
| 2005/0132502 | A1 * | 6/2005 | Goldoni et al. | 8/142 |

FOREIGN PATENT DOCUMENTS

| | | |
|---|---|---|
| FR | 2171978 | 9/1973 |
| JP | 09-143497 | 6/1997 |
| JP | 09-176684 | 7/1997 |
| JP | 2001-514337 | 9/2001 |
| JP | 2002-543951 | 12/2002 |
| WO | WO94/01227 | 1/1994 |
| WO | WO99/10585 | 3/1999 |
| WO | WO00/42249 | 7/2000 |
| WO | WO00/70141 | 11/2000 |
| WO | WO01/06053 | 1/2001 |
| WO | WO02/33039 | 4/2002 |

* cited by examiner

*Primary Examiner* — Milton I Cano
*Assistant Examiner* — M. Reza Asdjodi
(74) *Attorney, Agent, or Firm* — Jones Day

(57) ABSTRACT

Fatty branched polyalkoxylates, particularly of the formula: $R^1O(AO)_mR^2$ (I) where $R^1$ is $C_8$ to $C_{30}$ aliphatic hydrocarbyl or acyl; AO is predominantly branched alkyleneoxy, particularly propyleneoxy; m is from 2 to 50; and $R^2$ is H or a is $C_1$ to $C_4$ aliphatic hydrocarbyl or acyl, are used as fabric conditioners in $CO_2$ based dry cleaning systems. The cleaning medium may include detergent surfactant and/or non surfactant cleaning additive or may be free from such additives in which case the treatment can be provided in a rinse cycle in a cleaning process.

19 Claims, No Drawings

METHOD FOR CONDITIONING TEXTILES

CROSS REFERENCE TO RELATED APPLICATION

This application is the National Phase application of International Application No. PCT/GB2002/003828, filed Aug. 20, 2002, which designates the United States and was published in English. This application, in its entirety, is incorporated herein by reference.

This invention relates to conditioning textile materials and products including clothes, particularly as part of a dry cleaning process, using liquid carbon dioxide ($CO_2$) and conditioning agents, particularly branched polyalkyloxylate conditioning agents for the textiles.

The dry cleaning of clothes using fluid carbon dioxide, either as liquid or supercritical fluid, is known from many patents. An early suggestion is in U.S. Pat. No. 4,012,194 (Maffei) which teaches simply using liquid carbon dioxide as a substitute for halocarbon solvents e.g. perchlorethylene (perc), used in conventional dry cleaning. Later patents develop approaches using detergent materials, including US patents U.S. Pat. Nos. 5,676,705, 5,683,473, 5,683,977, 6,131,421, 6,148,644, and 6,299,652 assigned to Unilever and their equivalents, which relate to the use of defined detergents based on various classes of polymers and a series of cases, including U.S. Pat. Nos. 5,858,022, 6,200,352, 6,280,481, 6,297,206, 6,269,507 and US published application 200106053 A, assigned to MiCell and their equivalents. Also U.S. Pat. No. 5,279,615 assigned to Chlorox Co uses cleaning non-polar organic cleaning adjuncts, especially alkanes, in densified, particularly supercritical $CO_2$.

The major emphasis in these documents is to enhance the cleaning performance of the $CO_2$. However, other attributes of the cleaning system are also important in practice, in particular the ease of handling of textiles particularly clothes after cleaning, the ease with which subsequent steps, such as ironing, can be carried out and the appearance and feel of clothes in the hands of the end customer.

This invention is based on our finding that the inclusion of fatty branched polyalkoxylates, particularly fatty alcohol, branched polyalkoxylates, especially propoxylates, in $CO_2$ cleaning systems gives improved softness and handling characteristics to textiles, particularly clothes, after treatment.

The invention accordingly provides a method of dry cleaning which includes a conditioning step in which textile material, particularly clothes, is contacted with a treatment medium based on liquid $CO_2$ and which includes from 0.001 to 2.5% by weight of the treatment medium of a conditioning agent which includes at least one fatty alcohol or fatty acid branched polyalkyloxylate.

The term "branched polyalkyloxylate" refers to polyalkoxylate chains including a substantial proportion of units which have side chains e.g. as provided by propyleneoxy or butyleneoxy units. The term "fatty branched polyalkyloxylate" refers collectively to branched polyalkyloxylate based on fatty alcohols or fatty acids. In describing the medium as "based on liquid $CO_2$" we mean that the medium is liquid $CO_2$ which may include additives, in addition to the conditioning agent.

Desirably the alcohol branched polyalkyloxylate is of the formula (I):

$$R^1O(AO)_mR^2 \quad (I)$$

where $R^1$ is a $C_8$ to $C_{30}$ aliphatic hydrocarbyl group, particularly an alkyl or alkenyl group, or a $C_8$ to $C_{30}$ aliphatic acyl group;

AO is an alkyleneoxy group and is at least predominantly branched alkyleneoxy, particularly propyleneoxy;

m is from 2 to 50, particularly 2 to 30; and $R^2$ is H or a is a $C_1$ to $C_4$ aliphatic hydrocarbyl group, particularly an alkyl group, or a $C_1$ to $C_4$ acyl group, particularly an acetyl group.

When the group $R^1$ is an aliphatic hydrocarbyl group, particularly an alkyl or alkenyl group. Within the chain length range $C_8$ to $C_{30}$, the group has from $C_8$ to $C_{22}$, particularly $C_{12}$ to $C_{20}$, and especially $C_{16}$ or $C_{18}$, carbon atoms. The hydrocarbyl group is desirably an open chain group and may be linear or branched or a mixture of linear and branched chains. The groups may be saturated or unsaturated or a mixture of saturated and unsaturated groups.

When the group $R^1$ is an aliphatic acyl group, desirably it has from $C_8$ to $C_{22}$, particularly $C_{12}$ to $C_{20}$, and especially $C_{16}$ or $C_{18}$, carbon atoms. The acyl group is desirably an open chain group and may be linear or branched or have a mixture of linear and branched chains. The chains may be saturated or unsaturated or a mixture of saturated and unsaturated chains. The alkyleneoxy groups, -AO—, are typically all $C_2$ to $C_4$ groups while being predominantly branched alkyleneoxy e.g. propyleneoxy and/or butyleneoxy. In this context "predominantly" means that the molar proportion of branched alkyleneoxy residues in the polyalkyleneoxy chain is at least 50%. Desirably all the residues are all propylenoxy and/or butylenoxy residues. Mixed alkylene oxide chains may be used such as:

mixtures of propylenoxy and butylenoxy residues, when the molar ratio of propylenoxy residues to butylenoxy residues will usually be from 99:1 to 1:99 (more extreme ratios substantially correspond to chains made entirely of the majority residue), more usually from 10:1 to 1:10;

mixtures of propyleneoxy and ethyleneoxy residues, when the proportion of ethyleneoxy residues will usually not be more than 20%, more usually not more than 10% and desirably not more than 5%, of the total of propyleneoxy and ethyleneoxy residues; or mixtures of butylenoxy and ethyleneoxy residues, when the proportion of ethyleneoxy residues will usually not be more than 50%, more usually not more than 25% and may be not more than 10%, of the total of butyleneoxy and ethyleneoxy residues.

When the alkyleneoxy residues are mixed, the polyalkyleneoxy chain can be a random or block copolymeric chain. Within the range 2 to 50), m is desirably 2 to 30, more usually 5 to 25 and usually 7 to 20 The number of units in the polyalkylenoxy chain, 'm', is an average value and may be non-integral.

The group $R^2$ is H, or an end capping group such as a lower alkyl group e.g. a $C_1$ to $C_4$ alkyl group, and when other than H is desirably a methyl or ethyl group, or a $C_1$ to $C_4$ acyl group, particularly an acetyl group.

It is further desirable that the combined number of carbon atoms in the groups $R^1$ and $R^2$ is from 9 to 26 particularly from 15 to 24.

Desirably in compounds of the formula (I) used in this invention, the ratio of carbon atoms in the groups $R^1$ to the number of repeat units in the polyalkylene oxide chain $-(AO)_n-$ is from 8:1 to 1:4, particularly 6:1 to 1:2.

The amount of the conditioning agent alcohol branched polyalkyloxylate present in the cleaning medium is from 0.001 to 2.5%, usually from 0.005 to 2%, more usually from 0.01 to 1%, particularly from 0.01 to 0.1% and more particularly from 0.01 to 0.5% by weight of the cleaning medium. The use of lower amounts of conditioning agent will not generally give useful results and use of larger amounts does not appear to give additional benefits and may result in including so much conditioning agent in the system that conditioning agent residues are deposited onto the textiles being cleaned or left on the walls of the cleaning apparatus.

Cleaning additive materials i.e. Materials that improve the cleaning performance of liquid $CO_2$, can be included in the cleaning system. Typically such cleaning additives can be viewed as either detergent surfactants or non-surfactant cleaning additives.

The invention accordingly includes a method of dry cleaning which includes contacting textile material, particularly clothes, with a dry cleaning treatment medium based on liquid $CO_2$ and including from 0.001 to 2.5% by weight of the treatment medium of a conditioning agent which includes at least one fatty, particularly fatty alcohol, branched polyalkyloxylate, desirably of the formula (I) as defined above, in combination with at least one detergent surfactant and/or non-surfactant cleaning additive.

Detergent surfactants are materials that modify the interfacial properties of soils so that they are more readily separated from the textiles, particularly clothes on which the soil initially lies, and/or that the surfactant acts to minimise or prevent the re-deposition of soil onto the textiles. In aqueous systems, the structures of typical detergent surfactant compounds are well known, but in liquid $CO_2$ the nature of materials having useful detergent surfactant properties can be very dissimilar to those useful in aqueous systems. A wide range of detergent surfactants can be used in the present invention and examples of suitable types of detergent surfactants are given in the specifications referred to above.

Non-surfactant cleaning additives are materials, usually liquids which are miscible with liquid $CO_2$ or are solids which are soluble in liquid $CO_2$, which enhance the cleaning performance of $CO_2$ but are not surfactants. It is thought that such materials function to dissolve or soften soils that would otherwise not be removed well by liquid $CO_2$ or combine with the liquid $CO_2$ to enhance its solvent or soil softening properties. At least some such materials have been viewed as co-solvents in combinations with liquid $CO_2$.

Among such non-surfactant cleaning additives are relatively polar multi-esters i.e. compounds which have 2 or more carboxylic acid ester groups and generally a molecular weight of not more than 750, particularly of the formula (II):

$$R^{11}(XR^{12})_n \quad \text{(II)}$$

where

X is —C(O)O— or —OC(O)—; such that where X is —C(O)O—, $R^{11}$ is a direct bond or the residue of a $C_1$ to $C_{10}$ hydrocarbyl group from which n hydrogen atoms have been removed; and $R^{12}$ is a $C_1$ to $C_{10}$ hydrocarbyl group; and where X is —OC(O)—, $R^{11}$ is or the residue of a $C_2$ to $C_{10}$ hydrocarbyl group from which n hydrogen atoms have been removed; and $R^{12}$ is H or a $C_1$ to $C_{10}$ hydrocarbyl group; and n is from 2 to 5;

the compound having a molecular weight of not more than 750.

Such cleaning additive multi-esters can be divided into two sub-classes respectively of the formulae (IIa) and (IIb) below. Compounds of the formula (IIa) are esters of a multi-carboxylic acid and a mono-hydroxy alcohol:

$$R^{11a}(XR^{12a})_n \quad \text{(IIa)}$$

where

X is —C(O)O—;

$R^{11a}$ is a direct bond or the residue of a $C_1$ to $C_{10}$ hydrocarbyl group from which n hydrogen atoms have been removed;

$R^{12a}$ is a $C_1$ to $C_{10}$ hydrocarbyl group; and the compound having a molecular weight of not more than 750.

Examples of compounds of the formula (IIa) include diesters of dicarboxylic acids such as succinic, glutaric and adipic acids.

Compounds of the formula (IIb) are esters of a monocarboxylic acid and a multi-hydroxy alcohol:

$$R^{11b}(XR^{12b})_n \quad \text{(IIb)}$$

where

X is —OC(O)—;

$R^{11b}$ is or the residue of a $C_2$ to $C_{10}$ hydrocarbyl group from which n hydrogen atoms have been removed; and $R^{12b}$ is H or a $C_1$ to $C_{10}$ hydrocarbyl group; and the compound having a molecular weight of not more than 750.

Examples of compounds of the formula (IIb) include esters of multi-hydroxyl compounds such as triacetin (gycerol triacetate), ethylene glycol diacetate and pentaerythritol tetraacetate.

The invention accordingly includes a method of dry cleaning which includes contacting textile material, particularly clothes, with a dry cleaning treatment medium based on liquid $CO_2$ and including from 0.01 to 5% by weight of the treatment medium of a conditioning agent which includes at least one fatty branched polyalkyloxylate, desirably of the formula (I) as defined above, in combination with a cleaning additive, desirably at from 0.01 to 5% by weight of the cleaning medium, which is at least one multi-ester desirably having a molecular weight of not more than 750.

The invention further includes a, desirably detergent surfactant free, dry cleaning medium based on liquid $CO_2$ and including:

a from 0.01 to 5% by weight of the cleaning medium of a cleaning additive which is at least one multi-ester having a molecular weight of not more than 750, and desirably of the formula (II) as defined above; and b from 0.01 to 5% by weight of the treatment medium of a conditioning agent which includes at least one fatty branched polyalkyloxylate, desirably of the formula (I) as defined above.

Desirably the multi-ester used in this aspect of the invention, both method and composition, is a compound of the formula (II), especially (IIa), above, and particularly a dimethyl ester of adipic, glutaric or succinic acids or a mixture of such esters.

Within the formula (II) above, generally is desirable that the group X is —C(O)O— as these compounds seem to provide superior effects in cleaning. Among such compounds, the group $R^{11}$ is desirably —$(CH2)_p$— where p=2 to 6, particularly 2 to 4 and especially as in the mixed ester of succinic, glutaric and adipic acids; and the group $R^{12}$ is desirably methyl, ethyl or propyl, particularly methyl. Thus, the dimethyl esters of succinic, glutaric and adipic acids, particularly as mixtures are particularly desirable additives.

The molecular weight of the cleaning additive is desirably not more than 750 and is desirably not more than 500. In practice the molecular weight for individual components e.g. of formula (I) can be as low as 118 (dimethyl oxalate) but will not usually be lower than 146 (dimethyl succinate and ethylene glycol diacetate). More usually on average the molecular weight will be at least 150, particularly from 150 to 300. The mixed dimethyl esters of succinic, glutaric and adipic acids can have molecular weights ranging from about 150 to 170 e.g. for an approximately 1:1:3 mixture the average molecular weight is about 165.

In order to maintain the desired high polarity, the ratio of oxygen to carbon atoms in the molecules of the cleaning additive is (on average) desirably from 1:1 to 1:5 particularly from 1:1 to 1:3 and especially from 1:1 to 1:1.5. The mixed dimethyl esters mentioned above have an average ratio of ca 1:1.23.

The amount of cleaning additive multi-ester used will typically be from 0.01 to 5%, usually from 0.05 to 2%, more usually from 0.1 to 1%, particularly from 0.1 to 0.5% and more particularly from 0.1 to 0.3% by weight of the cleaning medium. The use of lower amounts of cleaning additive will not generally give useful results and use of larger amounts does not appear to give additional benefits and may result in including so much additive in the system that additive residues are deposited onto the textiles being cleaned or left on the walls of the cleaning apparatus.

When fatty alcohol branched polyalkyloxylate conditioning agents are used in combination with such multi-ester cleaning agents the amount of fatty branched alkoxylate will typically be from about 2 to about 20%, desirably from about 5 to about 15% and particularly about 10% of the total additive combination.

Other ingredients can be included in the dry cleaning formulation such as fragrances, optical brighteners, sizes e.g. starch, enzymes, bleaches, particularly peroxide bleaches e.g. organic and/or inorganic peroxides or hydrogen peroxide or a source of hydrogen peroxide.

The textiles to be cleaned will usually be garments and can be of woven or non-woven fabrics. The fibre making up the fabric can be or include a wide range of natural and synthetic fibres including polyamides particularly natural polyamides such as silk and wool and synthetic polyamides such as nylon, cellulosic fibres such as cotton, linen and rayon, synthetic polymers such as polyester, particularly polyethylene terephthalate or related copolymers, or acetate polymers. When fabrics including acetate polymers and possibly nylon polymers are cleaned it is best to avoid direct contact between the fabric and high concentrations of or neat multi-ester additives. When neat or at high concentration, the multi-ester additives may swell or dissolve such polymers leading to fabric damage. Thus it is desirable to pre-mix the multi-ester with $CO_2$ before permitting contact with such polymers. Premixing the multi-ester cleaning additive with $CO_2$ to give a concentration of less than about 10%, more usually less than 5%, and desirably not more than 2% by weight of the cleaning additive in the liquid $CO_2$ based cleaning medium before the additive comes into contact with the textile seems to avoid this potential problem.

The particular mode of operation will depend on the equipment used. Generally the cleaning will be carried out in a drum, which may have its axis vertical or horizontal. The textiles are introduced into the drum which is then sealed and filled with the cleaning medium including carbon dioxide typically to give a mixture of liquid and gaseous $CO_2$ in the drum. The textiles and liquid $CO_2$ based cleaning medium are then agitated to give thorough mixing and contact between the cleaning medium and textiles. The textiles will be contacted with the cleaning medium for a time adequate to clean the textiles to the desired extent. The cleaning medium is then separated from the textiles, typically by draining or venting it from the drum. Generally the textiles will be subject to one such cleaning cycle, but if desired the cleaning cycle may be repeated to obtain a higher degree of cleaning. Usually, the textiles are subject to at least one rinse cycle with liquid carbon dioxide usually not including cleaning additives, but which may include fabric softeners, optical bleaches etc if desired. The rinse liquid is similarly separated from the textiles, which can the n recovered by de-pressurising the drum and opening it to removed the textiles. One potentially advantageous way of carrying out this invention is to include the conditioning agent in the rinse cycle. This may mitigate the disadvantage noted above that combining the conditioning agent in the cleaning cycle with a cleaning agent may have detrimental effects on the cleaning performance. Though this can be managed, as is described above, the problem can be side stepped by including the conditioning agent in a rinse cycle.

The invention accordingly includes method of dry cleaning which includes contacting textile material, particularly clothes, with a dry cleaning treatment medium based on liquid $CO_2$ and including from 0.001 to 2% by weight of the treatment medium of a conditioning agent which includes at least one fatty branched polyalkyloxylate, the treatment medium not including any cleaning additives. Desirably in this aspect of the invention the treatment stage is applied as a rinse stage following a previous cleaning stage, which can be by liquid $CO_2$, desirably including at least one detergent and/or non-detergent cleaning additive.

In particular, in this aspect, the invention provides a method of dry cleaning which includes the steps of:

a contacting textile material with a dry cleaning medium based on liquid $CO_2$ and which is desirably detergent surfactant free, and which includes from 0.01 to 5% by weight of the cleaning medium of a cleaning additive which is at least one multi-ester, desirably of the formula (II), particularly (IIa), defined above, having a molecular weight of not more than 750;

b separating the textiles and the dry cleaning medium; and subsequently c contacting the textile material with a treatment medium based on liquid $CO_2$ and including from 0.001 to 2.5% by weight of the treatment medium of a conditioning agent which includes at least one fatty branched polyalkyloxylate, desirably of the general formula (I) as defined above; and desirably d separating the textiles and the treatment medium.

Any suitable apparatus for dry cleaning with liquid carbon dioxide can be used. Typically such apparatus includes a drum in which the cleaning is carried out. The drum may have its axis horizontal or vertical. (Other angles of orientation will generally be less convenient in operation.) Providing agitation in a horizontal axis drum can simply be by rotation around its axis. Vertical axis drums will usually include an agitator which can be moved to agitate the drum contents. Other means of agitation include paddles or vanes in the drum or by jetting liquid $CO_2$ into the mixture of cleaning medium and textiles in the drum. Suitably vigorous agitation may give rise to cavitation in the cleaning medium and this may improve the cleaning performance.

Typically the cleaning temperature will be from −10 to 25° C., more usually from 5 to 25° C., particularly from 10 to 20° C. The operating temperature will not usually be above about 25° C. to maintain the cleaning medium a reasonable margin from the critical point of $CO_2$, as supercritical $CO_2$ may extract textile dyes from fabrics. Operating at or near ambient temperature simplifies operation of the process, but using a lower temperature means that the $CO_2$ is more dense and a more effective cleaning agent. Temperatures in the range 10 to 17° C., particularly 12 to 15° C. generally provide a reasonable balance of properties and are thus advantageous.

During cleaning the cleaning medium must be kept at a pressure which maintains the $CO_2$ at least partially as a liquid. This will usually be the vapour pressure of the cleaning medium at the temperature of operation because, as is noted above, it is desirable for both liquid and gaseous $CO_2$ to be present. At the typical operating temperatures noted above, the corresponding pressures are approximately 2.7 to 6.4 MPa, more usually from 4 to 6.4 MPa, particularly from 4.5 to 5.7 MPa and balancing density and temperature 4.5 to 5.5 MPa, particularly from 4.9 to 5.1 MPa.

The invention is illustrated by the following Examples. All parts and percentages are by weight unless otherwise indicated.

Materials

FCA1 C18 linear alcohol 5-propoxylate

FCA2 C24 guerbet alcohol 5-propoxylate

FCA3 C24 guerbet 11-propoxylate

FCA4 C24 guerbet 24-propoxylate

FCA5 C18 linear alcohol 11-propoxylate

ME1 mixed esters: dimethyl adipate (ca 60%), dimethyl glutamate (ca 20%), and dimethyl succinate (ca 20%)

CD2 Fabritech 5565—conventional formulated detergent surfactant

CD3 Conventional detergent surfactant (composition not known)

Cleaning testing used standard "Krefeld" stained cloths. The codes for these cloths include a number indicating the fabric type and a letter or letters indicating the soil as follows:

| Cloth Type | | Soil Type | | |
|---|---|---|---|---|
| cotton | C | WFK soil*/lanolin mix | GM | used motor oil |
| polycotton | D | sebum | TE | clay |
| polyester (PET) | LS | Lipstick | PF | pigment/ vegetable fat |

*WFK soil - a mixed soil based on kaolinite and containing soot and iron oxide pigments Cleaning effectiveness—was assessed spectrometrically (using an X-Rite Spectrophotomeric Colour Measurement system) by comparison of commercially available standard soiled cloths before and after cleaning with the results given as % stain removal.

EXAMPLE 1

A number of fabric conditioning fluids were made up based on liquid $CO_2$ and were used to treat textile samples. The compositions are set out in Table 1 below:

TABLE 1

| | Additive | | |
|---|---|---|---|
| Ex No | type | amount | Run No |
| 1.1 | FCA1 | 0.1 | 1.1.1 |
| | | 0.2 | 1.1.2 |
| 1.2 | FCA1 | 0.1 | 1.2.1 |
| 1.3 | FCA1 | 0.1 | 1.3.1 |
| 1.4 | FCA1 | 0.1 | 1.4.1 |
| 1.5 | FCA1 | 0.2 | 1.5.1 |

EXAMPLE 2

Further tests were carried out in commercial scale liquid $CO_2$ dry cleaning equipment using standard Krefeld soiled cloths, pinned to blank textile sheets to provide more realistic behaviour in the cleaning machine. The results are set out in Table 2 below:

TABLE 2

| | Cleaning Additive | | Conditioner | | | | | | | | |
|---|---|---|---|---|---|---|---|---|---|---|---|
| Ex No | type | % | type | % | 30C | 30D | 20MU | 10LS | 10PF | 10TE | 10GM |
| 2.1.c1 | — | 0 | — | 0 | 37.6 | 63.6 | 31.7 | 37.9 | 40.5 | 17.8 | 25.9 |
| 2.1.c2 | CD3 | 0.2 | n/a | — | 45.1 | 63.4 | 32.9 | 35.6 | 39.8 | 21.9 | 23.1 |
| 2.1 | ME1 | 0.18 | FCA1 | 0.02 | 35.7 | 63.5 | 21.5 | 34.5 | 45.3 | 31.7 | 20.6 |
| 2.2.c1 | — | 0 | — | 0 | 41.6 | 55.1 | 30.7 | 36.2 | 37.6 | 17.8 | 26.1 |
| 2.2.c2 | CD2 | 0.2 | n/a | — | 20 | 35.3 | 21.4 | 32.1 | 29 | 14 | 21.6 |
| 2.2 | ME1 | 0.18 | FCA1 | 0.02 | 47.7 | 59.9 | 36.3 | 37.9 | 45.9 | 28.4 | 29.5 |

The textiles cleaned using combined cleaning and conditioning additives according to the invention had much improved feel on removal from the cleaning machines and were less wrinkled and easier to iron than those cleaned with liquid $CO_2$ alone or using the commercial detergent surfactant additives.

The invention claimed is:

1. A method of dry cleaning a textile material, comprising:

i. cleaning the textile material by contacting the textile material with a dry cleaning medium based on liquid $CO_2$ which includes at least one detergent surfactant and/or non-surfactant cleaning additive;

ii. separating the cleaned textile material from the dry cleaning medium; and iii. conditioning the cleaned textile material by contacting the cleaned textile material with a treatment medium based on liquid $CO_2$ which includes from 0.001 to 2.5% by weight of a conditioning agent, relative to the total weight of the conditioning treatment medium, wherein the conditioning agent comprises at least one fatty alcohol branched polyalkyloxylate or fatty acid branched polyalkyloxylate.

2. A method as claimed in claim 1, wherein the fatty alcohol branched polyalkyloxylate is of the formula (I):

$$R^1O(AO)_mR^2 \quad (I)$$

where $R^1$ is a $C_8$ to $C_{30}$ aliphatic hydrocarbyl group or a $C_8$ to $C_{30}$ aliphatic acyl group;

AO is an alkyleneoxy group having a molar portion of branched alkyleneoxy residues of at least 50%;

m is from 2 to 30; and $R^2$ is H or is a $C_1$ to $C_4$ aliphatic hydrocarbyl group or a $C_1$ to $C_4$ aliphatic acyl group.

3. A method as claimed in claim 2 wherein the group $R^1$ is a $C_8$ to $C_{22}$ alkyl group or a $C_8$ to $C_{22}$ alkenyl group.

4. A method as claimed in claim 2 wherein the groups AO are propyleneoxy and/or butyleneoxy groups.

5. A method as claimed in claim 2 wherein the group $R^2$ is H, a methyl or ethyl group, or an acetyl group.

6. The method of claim 2, wherein $R^1$ is a $C_8$ to $C_{30}$ aliphatic hydrocarbyl group.

7. The method of claim 1, wherein the concentration of the conditioning agent fatty alcohol branched polyalkyloxylate in the cleaning medium is 0.01 to 1% by weight of the cleaning medium.

8. The method of claim 1, wherein the textile material is contacted with a dry cleaning treatment medium further including at least one detergent surfactant and/or non-surfactant cleaning additive.

9. A method as claimed in claim 8 wherein the non-surfactant cleaning additive is a multi-esters of the formula (II):

$$R^{11}(XR^{12})_n \quad \text{(II)}$$

where

X is —C(O)O— or —OC(O)—; such that where X is —C(O)O—, $R^{11}$ is a direct bond or the residue of a $C_1$ to $C_{10}$ hydrocarbyl group from which n hydrogen atoms have been removed; and $R^{12}$ is a $C_1$ to $C_{10}$ hydrocarbyl group; and where X is —OC(O)—, $R^{11}$ is or the residue of a $C_2$ to $C_{10}$ hydrocarbyl group from which n hydrogen atoms have been removed; and $R^{12}$ is H or a $C_1$ to $C_{10}$ hydrocarbyl group; and n is from 2 to 5;

the compound having a molecular weight of not more than 750.

10. The method of claim 1, wherein the textile material is contacted with the conditioning treatment medium, which does not include any cleaning additives, in a rinse cycle.

11. The method of claim 1, wherein the treatment medium does not contain a cleaning additive.

12. The method of claim 1, wherein the fatty alcohol branched polyalkyloxylate is of the formula (I):

$$R^1O(AO)_mR^2 \quad \text{(I)}$$

where $R^1$ is a $C_8$ to $C_{30}$ aliphatic hydrocarbyl group or a $C_8$ to $C_{30}$ aliphatic acyl group;

AO is an alkyleneoxy group having a molar proportion of branched alkyleneoxy residues of at least 50%;

m is from 2 to 30; and $R^2$ is H or is a $C_1$ to $C_4$ aliphatic hydrocarbyl group or $C_1$ to $C_4$ aliphatic acyl group.

13. The method of claim 12, wherein $R^1$ is a $C_8$ to $C_{30}$ aliphatic hydrocarbyl group.

14. The method of claim 1, wherein the non-surfactant cleaning additive is a multi-ester cleaning additive having a molecular weight of not more than 750.

15. A method of rinsing a dry cleaned textile material, comprising:

contacting a textile material that has been dry cleaned with a conditioning treatment medium based on liquid $CO_2$ which includes a conditioning agent that comprises at least one fatty alcohol branched polyalkyloxylate or fatty acid branched polyalkyloxylate.

16. The method of claim 15, wherein the conditioning treatment medium does not contain a cleaning additive.

17. The method of claim 15, wherein the conditioning treatment medium comprises from 0.001 to 2.5% by weight of the conditioning agent, relative to the total weight of the conditioning treatment medium.

18. The method of claim 15, wherein the fatty alcohol branched polyalkyloxylate is of the formula (I):

$$R^1O(AO)_mR^2 \quad \text{(I)}$$

where $R^1$ is a $C_8$ to $C_{30}$ aliphatic hydrocarbyl group or a $C_8$ to $C_{30}$ aliphatic acyl group;

AO is an alkyleneoxy group having a molar proportion of branched alkyleneoxy residues of at least 50%;

m is from 2 to 30; and $R^2$ is H or is a $C_1$ to $C_4$ aliphatic hydrocarbyl group or $C_1$ to $C_4$ aliphatic acyl group.

19. The method of claim 18, wherein $R^1$ is a $C_8$ to $C_{30}$ aliphatic hydrocarbyl group.

* * * * *